United States Patent [19]

Kohler

[11] 3,944,771

[45] Mar. 16, 1976

[54] OVERCURRENT PROTECTION DEVICE

[75] Inventor: Werner Kohler, Bentfeld, Germany

[73] Assignee: Siemens Aktiengesellschaft, Munich, Germany

[22] Filed: Dec. 14, 1973

[21] Appl. No.: 424,690

[30] Foreign Application Priority Data

Dec. 29, 1972 Germany ..... 2264342

[52] U.S. Cl. ..... 200/144 B; 335/3

[51] Int. Cl.[2] ..... H01B 33/66

[58] Field of Search ..... 200/144 B; 335/3

[56] References Cited

UNITED STATES PATENTS

| | | | |
|---|---|---|---|
| 1,865,274 | 6/1932 | Prince | 200/144 B |
| 2,027,064 | 1/1936 | Rozumek | 200/144 B |
| 3,390,305 | 6/1968 | Greenwood | 200/144 B |
| 3,411,038 | 11/1968 | Lee | 200/144 B |

FOREIGN PATENTS OR APPLICATIONS

| | | | |
|---|---|---|---|
| 607,604 | 1/1935 | Germany | 200/144 B |
| 216,089 | 7/1968 | U.S.S.R. | 335/3 |

*Primary Examiner*—Robert S. Macon
*Attorney, Agent, or Firm*—Kenyon & Kenyon Reilly Carr & Chapin

[57] ABSTRACT

The invention concerns an overcurrent protection device which comprises contacts adapted to operate in dependence on the current. The set of contacts are arranged in a vacuum vessel, with one of the contacts guided movably via an actuator rod through an end wall of the vessel, while the other is secured to the opposite end. The moving rod cooperates with a latching device, which holds the contact in the open position. The latching device is designed so that it can be released when desired. If an overcurrent occurs, the contacts are separated by electrodynamic forces and are secured in the separated position by the latching device. After release of the latching device, the overcurrent protection device is again ready for use.

7 Claims, 7 Drawing Figures

OVERCURRENT PROTECTION DEVICE

FIELD OF THE INVENTION

This invention pertains to overcurrent protection devices but more particularly to reuseable type devices employing contacts adopted to operate in dependence on the current.

BACKGROUND OF THE INVENTION

Overcurrent protection devices are used to protect electrical installations and delicate equipment against excessive currents. The more expensive, repeatable type devices employ monitoring equipment to detect when the current exceeds a prescribed threshold. This equipment is adapted to activate a switching mechanism which is in line with the conductor drawing the excessive current or alternately is adapted to cutout the voltage or current source supplying the load.

In addition to this relatively expensive manner it is also known to insert into the circuits to be protected, fuses whose fusible link is melted by the overcurrent until opened. In contrast to overcurrent protection switches, fuses can be used only once however.

Another known design for overcurrent protection devices is described in U.S. Pat. No. 3,613,039. Therein is described a vacuum switching vessel which comprises two electrodes which face each other at a distance and between which fusible links are disposed. An overcurrent causes these fusible links to evaporate, whereby a metal vapor arc is ignited between the electrodes. This arc is extinguished after a short time in a manner similar as in the known vacuum switching vessels. However, protective devices of this kind, too, can be used only once. It is therefore an object of this invention to provide an overcurrent protection device which can be used several times but is of simpler design and requires less space than the known overcurrent protection switches. It is another object of this invention to provide an overcurrent protection device which is fast responding and which can be automatically reset.

SUMMARY OF THE INVENTION

It is therefore the purpose of this invention to provide an overcurrent protection device employing a set of contacts which open in response to an excessive current. The contacts are arranged, according to the invention, in a vacuum vessel, wherein the one contact is movably guided via an actuator rod, through one end wall of the vessel while the other is secured to the opposite end. The moving rod cooperates with a latching mechanism which holds the contact in the open position. A preferable mechanism for opening the contacts involves attaching the movable actuator rod to a helically wound conductor which contracts suddenly when an overcurrent flows through it. This causes the rod to move and the contacts to separate. The wound conductor can be arranged outside as well as inside the vessel. The advantage of this type actuating device is that it has an extremely quick response.

The latching mechanism includes a projection, secured to the actuator rod, which pushes through a resilient stop when the rod moves in response to an overcurrent condition. The projection is designed to restrain the return movement of the rod by "hanging up" on the stop which regains its original shape once the projection passes therethrough.

This stop can either consist of soft magnetic material or can have a soft magnetic extension which can be influenced by a magnet device for releasing the latching device. For instance, a magnet coil can be arranged at the outer circumference of the vacuum vessel, which acts on the soft magnetic stop or its soft magnetic extension and releases the movable contact. The overcurrent protection device is then returned to its original position.

In order to make the switching state of the overcurrent protection device easily visible, it is possible to provide the actuator rod of the movably guided contact with a magnetically responsive member which cooperates with a position-indicating element arranged outside the vacuum vessel. This has the advantage that the position indication is derived from the movable contact and the actual switch position is indicated independently of possible faults in the external drive parts of the vacuum vessel.

For use in multi-phase systems, several vacuum vessels can be mounted, depending on the number of phases, on a common carrier and provided with a common resetting device. In this manner an overcurrent protection device is created which requires no more space than a multi-pole set of fuses but, in contrast thereto, can be used several times and responds more quickly.

DESCRIPTION OF THE DRAWINGS

Reference is now made to the accompanying drawings for a better understanding of the nature and objects of this invention. The drawings illustrate the preferred modes presently contemplated for carrying out the objects of the invention and its principles, and are not to be construed as restrictions or limitations on the scope of the invention. In the drawings.

Figure 1:
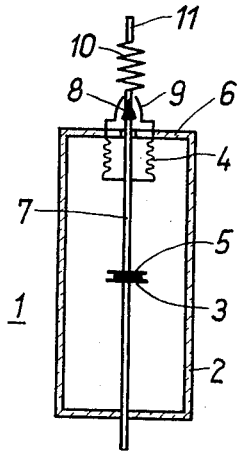
FIGS. 1 and 2 show an elevational, sectional view of one embodiment of an overcurrent protection device according to this invention.
Figure 2:
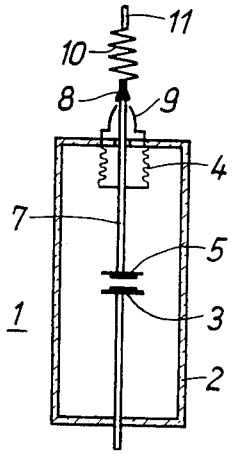

The overcurrent protection device 1 according to FIGS. 1 and 2 comprises a vacuum vessel 2, which may consist, for instance, of a cylinder of ceramic material, whose end faces are closed off by metal caps. However, the vacuum vessel 2 can also consist exclusively of ceramic material or glass. The vacuum vessel 2 contains a stationary contact 3 and a contact 5 which is arranged movably by means of resilient bellows 4. The actuator rod 7 of the movable contact 5, which protrudes through the upper end face 6 of the vacuum vessel 2 carries an inclined surface 8, rigidly secured thereto, by which two resilient tongues 9 are pushed aside when the actuator rod 7 occupies the position indicated in FIG. 2.

Contractible circuit means in the form of a helically wound conductor 10 is arranged between a stationary terminal member 11 and the actuator rod 7. The movable contact 5 and the actuator rod 7 are moved from the position according to FIG. 1 into the position according to FIG. 2 by the forces which a current substantially exceeding the operating current in the helically wound conductor 10 produces. The overcurrent protection device can be arranged for different response currents by the design of the contractible circuit means in the form of the conductor 10. Once the inclined surface 8 has passed beyond the resilient tongues 9, the under portion thereof as viewed in FIG. 2, comes to rest on top of the resilient tongues to thereby prevent the actuator rod 7 from returning into the original position.

If the overcurrent protection device is to be returned to its original position (FIG. 1), it is only necessary to spread the resilient tongues 9 apart by a suitable device. For example the resilient tongues can have a projection (not shown) extending therefrom, similar to extensions 13 in FIG. 3, made from a soft magnetic material. Alternately, the tongues may be impregnated with a suitable magnetic material. This material will respond to a magnetic field provided by a suitably arranged magnet device (not shown). Under the influence of this field the tongues 9 are spread sufficiently far apart that the inclined surface 8 can now pass between them, allowing the contacts 3 and 5 to come into contact with each other in response to the force exerted by atmospheric pressure and, if necessary, an additional contact force spring, not shown.

Figure 3:
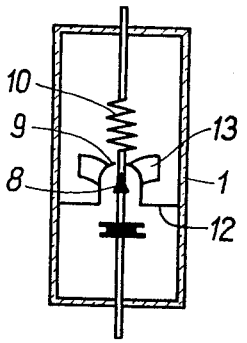
FIGS. 3 and 4 show an elevational, sectional view of another embodiment of the overcurrent protection device according to this invention.
Figure 4:
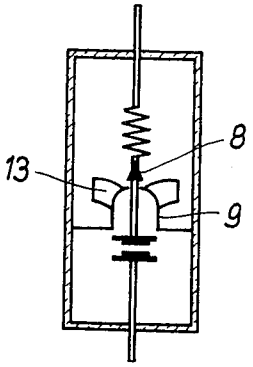
Figure 5:
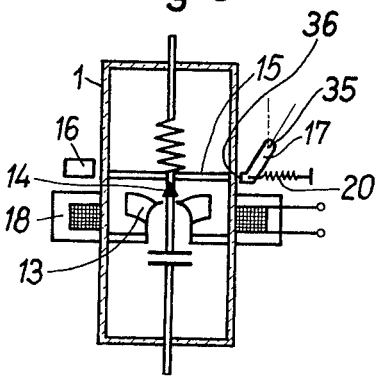
FIG. 5 is the embodiment of FIGS. 3 and 4 with the inclusion of another feature of this invention.

Differing from FIGS. 1 and 2, contractible circuit means in the form of the helically wound conductor 10 and the latching device consisting of the parts 8 and 9 are arranged inside the vacuum vessel 2 in the example of an embodiment according to FIGS. 3 and 4, the design being, in principle, otherwise the same. The resilient tongues 9 are attached to a ring 12, which may, for instance, be melted into the cylindrical part of the vacuum vessel 2. The resilient tongues 9 are provided with soft magnetic extensions 13, on which a magnetic field can act. As shown in FIG. 5, a ring coil 18 arranged at the outer circumference of the vacuum vessel 2, for instance, can be excited to spread the resilient tongues 9 apart to thereby release the movable contact. Spring bellows are not necessary in this example of an embodiment, as the actuating device for the contact 5 is arranged inside the vacuum vessel 2. A permanent magnet 16 and a pivoted, indicating armature 17 made of material responsive to a magnetic field are positioned outside of the vessel. Armature 17 is pivoted about a point 35 and is kept in the vertical position as viewed in FIG. 5, when contacts 3 and 5 are closed, by the action of tension spring 20. A crosspiece rod 15, in the closed contact position, lies below the plane of 16 and the inward facing surface 36 of armature 17. If the contacts are open, the actuator rod 14 moves vertically with the crosspiece 15 attached. The gap between the permanent magent 16 and the inward surface 36 of armature 17 is substantially bridged by the crosspiece 15 thereby forming a closed magnetic circuit. This causes the armature 17 to pivot clockwise as viewed in FIG. 5 about point 35 assuming the position indicated and retaining it until the latching mechanism is reset. Once reset the crosspiece 15 drops and armature 17 is again returned to the vertical position by the action of spring 20.

Figure 6:
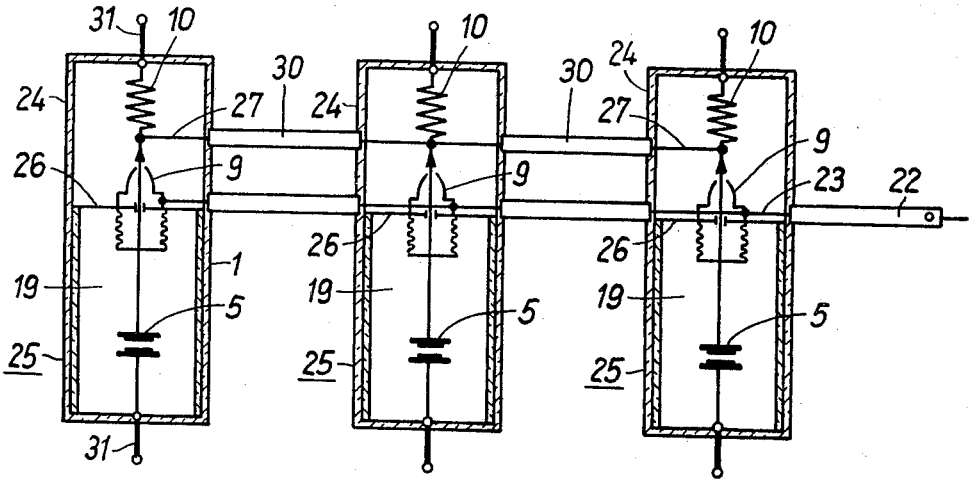
FIGS. 6 and 7 show in an elevational, sectional view and in a perspective view a three-pole overcurrent protection device according to this invention.
Figure 7:
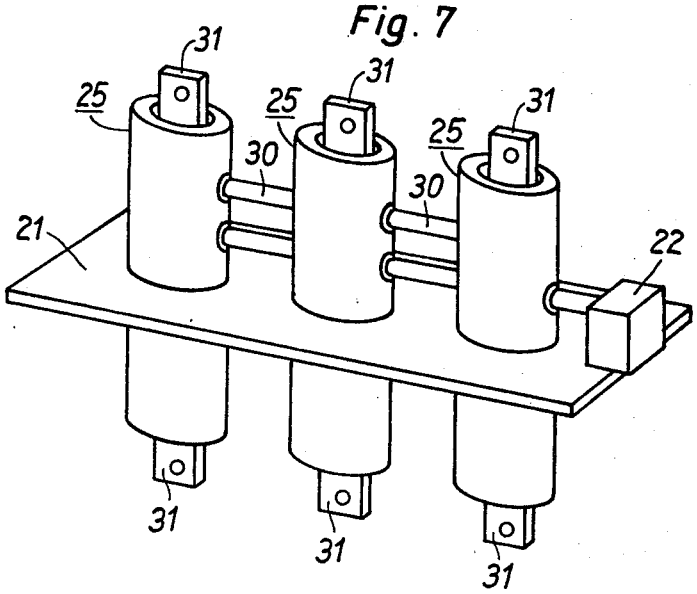

Several vacuum vessels of the kind described can be combined in a multi-pole unit if an overcurrent protection device for multi-phase systems is required. An example of this is shown in FIGS. 6 and 7. Three vacuum vessels of a design largely corresponding to FIGS. 1 and 2 are mounted in a carrier plate 21 and have a common device 22 for resetting the movable contacts 5. As shown in FIG. 6, this device works with a linkage

23 which connects all the latching devices and by which all the resilient tongues 9 can be spread apart simultaneously. The actuator device (contractible circuit means in the form of conductor helix 10) for the movable contact of each vacuum vessel is located together with the latching device in an extension chamber 24 above the vacuum chamber 19 proper. As shown in FIGS. 6 and 7, a common housing 25 is provided for the vacuum chamber 19 and the extension 24 of each pole, which is divided by a partition 26 into the vacuum chamber 19 and the extension 24. The actuator rods, accessible in the extensions 24, of the movable contacts 5 are connected with each other by a coupling linkage 27 in such a manner that all poles of the overcurrent protection device are operated, even if overcurrent flows only in one pole. The coupling linkage 27 is shown in FIG. 6 only schematically. It can be designed in the manner of a crankshaft and supported in the tube sections 30, which are arranged between the extensions 24. Each housing 25 is provided at its upper and lower end with a terminal 31.

FIG. 7 shows furthermore the simple design of the overcurrent protection device according to the invention and its advantageous application offered thereby in electrical installations.

It is to be appreciated that changes in the above embodiments can be made without departing from the scope of the present invention.

For instance, the movable contact can be connected to an actuator device in which the necessary interrupt force is continuously stored. Upon sensing the overcurrent condition, a suitable electromagnetic device responds by releasing the interrupt force, opening the contacts.

Other variations of the specific construction disclosed above can be made by those skilled in the art without departing from the invention as defined in the appended claims.

What is claimed is:

1. An overcurrent protection device comprising:

a vacuum vessel;

a terminal member fixedly mounted with respect to said vacuum vessel;

a pair of contact pieces arranged in said vacuum vessel;

at least one of said contact pieces being mounted so as to be movable with respect to said terminal member and with respect to the other one of said contact pieces between first and second positions whereby said contact pieces are closed and opened respectively;

contractible circuit means serially and mechanically connected between said terminal member and said one contact piece for contracting in response to an overcurrent passing therethrough thereby acting on said one contact piece to move the same from said first position to said second position;

latching means for latching said movable contact piece when the same is moved to said second position thereby preventing the closing of said contact pieces; and releasing means for releasing said latching means thereby allowing said contact pieces to close.

2. The device of claim 1, said contractible circuit means comprising a fixedly mounted circuit member, and a helically wound, flexible conductor for contracting in response to the electrodynamic forces developed by said overcurrent, said flexible conductor being connected at one end thereof to said circuit member and connected at the other end thereof to said one contact piece.

3. The device of claim 2, said one contact piece including an actuator rod; said latching means comprising;

a. a projection fixedly secured to said actuator rod of said one contact piece;

b. resilient stop means positioned axially about said actuator rod whereby said resilient stop means separates upon contact with said projection when said one contact piece is acted upon by said actuator means allowing said projection to pass therethrough, said resilient stop means thereafter closing about said actuator rod to thereby prevent said projection means from passing in the opposite direction.

4. The device of claim 3 wherein said means for releasing comprises:

an extension of magnetically soft material secured to said resilient stop means; and magnetic means for attracting said extension to thereby open said resilient stop means allowing said projection to pass backthrough.

5. The device of claim 4 where said magnetic means includes a magnet coil positioned about the outer circumference of said vacuum vessel.

6. The device of claim 1 wherein said one contact piece includes an actuator rod, and wherein the device further comprises:

a. a means for creating a magnetic field in a plane transverse to said movable connecting means;

b. a crosspiece rod transversely connected to said actuator rod of said one contact piece;

c. means for indicating the position of said one contact piece of said device, said indicating means positioned in the plane of said magnetic field and magnetically responsive to the positioning of said crosspiece rod in the plane of said magnetic field when said contacts are opened.

7. The device of claim 1 combined with at least one additional like overcurrent device to form a multiphase overcurrent apparatus for a multiphase system, each of the devices being provided for a corresponding ones of the phases of the multiphase system, the multiphase overcurrent apparatus comprising:

a. means connecting all of said one contact pieces together such that if one of said one contact pieces moves in response to an overcurrent condition, all of said one contact pieces will move; and b. means connected between each of said releasing means for allowing all of said pair of contacts to close simultaneously.

* * * * *